US011246202B2

(12) United States Patent
Zijlman et al.

(10) Patent No.: US 11,246,202 B2
(45) Date of Patent: Feb. 8, 2022

(54) LED LIGHTING DRIVER AND DRIVE METHOD

(71) Applicant: SIGNIFY HOLDING B.V., Eindhoven (NL)

(72) Inventors: Theo Gerrit Zijlman, Eindhoven (NL); Bertrand Johan Edward Hontele, Eindhoven (NL); Marinus Joseph Maria Kahlman, Eindhoven (NL); Min Yang, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/500,674

(22) PCT Filed: Apr. 5, 2018

(86) PCT No.: PCT/EP2018/058765
§ 371 (c)(1),
(2) Date: Oct. 3, 2019

(87) PCT Pub. No.: WO2018/189032
PCT Pub. Date: Oct. 18, 2018

(65) Prior Publication Data

US 2020/0092966 A1 Mar. 19, 2020

(30) Foreign Application Priority Data

Apr. 14, 2017 (WO) ..... PCT/CN2017/080544
May 19, 2017 (EP) ..... 17171881

(51) Int. Cl.
*H05B 45/44* (2020.01)
*H05B 45/10* (2020.01)

(52) U.S. Cl.
CPC ..... *H05B 45/44* (2020.01); *H05B 45/10* (2020.01)

(58) Field of Classification Search
CPC ..... H05B 33/0806; H05B 33/0815; H05B 33/0845; H05B 45/10; H05B 45/37; H05B 45/44; H02M 1/0006; H02M 1/0032; H02M 1/0035; H02M 3/155–1588
USPC ..... 315/160, 291
See application file for complete search history.

(56) References Cited

U.S. PATENT DOCUMENTS 5,481,450 A 1/1996 Lee et al.
8,222,872 B1 * 7/2012 Melanson ..... H02M 3/155 323/222
8,829,819 B1 * 9/2014 Angeles ..... H05B 45/375 315/308

(Continued)

FOREIGN PATENT DOCUMENTS

WO 0038304 A1 6/2000

*Primary Examiner* — Alexander H Taningco
*Assistant Examiner* — Amy X Yang
(74) *Attorney, Agent, or Firm* — Daniel J. Piotrowski

(57) ABSTRACT

An LED lighting driver has a switched mode power supply which generates an auxiliary power supply. The auxiliary power supply circuit has a first power supply inductor and a second power supply inductor in series with each other. The second power supply inductor is selectively switched into or out of the auxiliary power supply circuit, thereby varying a transformer ratio to the main energy storage inductor. The switching may be made based on a light output mode or a standby mode being in operation. The standby mode then enables more efficient generation of an auxiliary supply voltage.

14 Claims, 4 Drawing Sheets

(56) References Cited

U.S. PATENT DOCUMENTS

| | | | | |
|---|---|---|---|---|
| 8,922,129 | B1 * | 12/2014 | Rodriguez | H05B 45/375 315/224 |
| 2002/0047693 | A1 * | 4/2002 | Chang | H02M 1/44 323/222 |
| 2014/0152192 | A1 * | 6/2014 | Kim | H05B 45/385 315/283 |
| 2014/0239829 | A1 * | 8/2014 | Zhang | H05B 45/382 315/200 R |
| 2016/0226384 | A1 | 8/2016 | Nishijima | |
| 2017/0085135 | A1 * | 3/2017 | Stevens | H02J 50/80 |

* cited by examiner

LED LIGHTING DRIVER AND DRIVE METHOD

CROSS-REFERENCE TO PRIOR APPLICATIONS

This application is the U.S. National Phase application under 35 U.S.C. § 371 of International Application No. PCT/EP2018/058765, filed on Apr. 5, 2018, which claims the benefits of European Patent Application No. 17171881.0, filed on May 19, 2017 and Chinese Patent Application No. PCT/CN2017/080544, filed on Apr. 14, 2017. These applications are hereby incorporated by reference herein.

FIELD OF THE INVENTION

This invention relates to LED lighting, and in particular to an LED lighting driver.

BACKGROUND OF THE INVENTION

Solid state lighting units, and in particular LED-based (retrofit) lamps, are used more and more in home buildings and offices. Besides their high efficiency they also attract consumers due to new design features, different color temperatures, dimming ability etc.

To fit LED lighting to existing mains lighting fixtures, each LED light unit makes use of a converter circuit, for converting the AC mains into a DC drive signal, and also for reducing the voltage level.

The converter circuit typically comprises a rectifier and a switched mode power converter.

There are various possible designs of switched mode power converter. A low-cost switched mode power converter is a single stage converter, such as a buck converter or a buck-boost converter. In both cases, there is a main inductor which controls the delivery of energy to the load. A main power switch controls the supply of energy from the input to the main inductor.

The timing of operation of the main power switch, in particular the duty cycle, controls the energy transfer. A ringing choke converter (RCC) is a typical self-oscillation converter in which the cyclic operation of the switching is self-controlled, and is widely used as a low-cost LED driver. Alternatively, an IC-based converter has control of the main power switch using an IC. This IC may then implement additional functionality, such as dimming control.

There is a desire to reduce the size or number of components within the driver circuit, since there is limited PCB space within an LED light unit, as well as to reduce cost. For a dimmable LED, local control circuitry is also needed.

To reduce the costs of a dimmable solution, integration of an auxiliary power supply with the already-needed switched mode power converter has been proposed. An auxiliary power supply can be generated using a flyback auxiliary supply.

One approach to the generation of a stable auxiliary supply is to provide a controlled voltage for the auxiliary supply and a controlled voltage for the main load. However, this is not the cheapest and most efficient implementation for connected lamps. Especially for a single stage, single string LED implementation, current control is desired for the LED load and voltage control is desired for the auxiliary supply.

It is desired to provide high efficiency at all dimming levels as well as during a standby (off) state. However, the combination of LED current control with an auxiliary power supply which remains efficient even during standby in a low-cost switched mode converter (such as a buck converter) is not straightforward. In the standby state, the LEDs should be turned off, so the output voltage of the switched mode power supply should be low but the auxiliary power supply (for a microcontroller unit, MCU) should remain at the same level. If the transformer for the auxiliary supply achieves this aim, it means that in the on state, the voltage of the auxiliary supply is likely to be too high.

Thus, the transformer ratio for the auxiliary power supply is not ideal for both states. In a standby mode, the output voltage would ideally be lower than half of the LED forward voltage. This means the auxiliary supply output voltage doubles during normal operation compared to during the standby mode. This gives rise to significant losses. The capacitive load on the main output also makes the control of the auxiliary supply difficult.

There is therefore a need for a low-cost driver architecture which enables efficient generation of an integrated auxiliary power supply during all operational modes of the main LED lighting load.

US 2014/0239829 discloses an LED driver including: a first and a second auxiliary windings connected in series with each other; a first rectifying device coupled with a terminal of the first auxiliary winding while the other terminal is coupled with the second auxiliary winding; a second rectifying device coupled with a terminal of the second auxiliary winding; a first voltage regulator coupled with the first rectifying device; an unidirectional conducting device having a positive and a negative terminals; and a DC output terminal coupled with the negative terminal of the unidirectional conducting device and configured to provide required DC electricity to a control circuit in the LED driver. The LED driver can guarantee that V cc voltages provided under a heavy or light load state can always meet the DC power supplying requirements of respective control devices in the driver and meanwhile losses can be reduced.

SUMMARY OF THE INVENTION

The invention is defined by the claims.

According to examples in accordance with an aspect of the invention, there is provided an LED lighting driver comprising:

a switched mode power supply having an energy storage inductor for delivering energy to an LED lighting load; and an auxiliary power supply circuit comprising a power supply inductor arrangement magnetically coupled to the energy storage inductor and a rectifier diode arrangement for delivering a rectified voltage to an auxiliary load, wherein the power supply inductor arrangement comprises a first power supply inductor and a second power supply inductor, wherein the auxiliary power supply circuit further comprises a switching circuit for selectively switching the second power supply inductor into or out of the auxiliary power supply circuit, thereby varying a transformer ratio to the energy storage inductor, and wherein the LED lighting driver further comprises a controller for controlling the switching circuit in dependence on a desired lighting level.

This driver controls a lighting load as well as generating an auxiliary supply. In order to make the generation of the auxiliary supply efficient, a switchable transformer ratio is implemented. This means that the voltage across the lighting load can be reduced (to switch the lighting off) while maintaining a desired power transfer to the auxiliary power supply circuit, so that a desired auxiliary power supply voltage can be generated in an efficient manner.

The controller is for example adapted to control the switching circuit to connect the second power supply inductor into the auxiliary power supply circuit when the LED lighting is in a standby mode and to disconnect the second energy storage inductor from the auxiliary power supply circuit when the LED lighting is in a light output mode.

Thus, the power supply inductor arrangement may be configured as a single inductor or two inductors in series. With a constant inductor at the switch mode power supply side, the transformer ratio is then controllable between two values. A transformer ratio based on a larger number of turns on the secondary side enables a sufficient auxiliary supply voltage to be generated from a smaller voltage drop across the main energy storage inductor. This corresponds to a smaller transformer ratio (e.g. 4:2 instead of 4:1).

The switching circuit may comprise:

a first diode between a reference terminal and a first end of the second power supply inductor where it connects to the first power supply inductor; and a second diode between the reference terminal and a second end of the second power supply inductor; and a switch in series with the second diode.

The switch is used to control whether or not the second power supply inductor is in the circuit or not. When the switch is closed, both power supply inductors are operable in the circuit, and this has the automatic effect of reverse biasing the first diode. Thus, the second diode functions as the rectifying diode of the auxiliary power supply switched mode power supply. When the switch is open, only the first power supply inductor is operable in the circuit, and the first diode functions as the rectifying diode of the switched mode power supply.

The driver may further comprise a preload at the output of the driver for delivering enough and (controlled) stable standby power and voltage. In standby mode, the main output is delivering no power (the LEDs of the lighting load are off) but there is stored energy needed during the on-time of the switch in the main inductor. Therefore, the preload is provided to store the energy in the main inductor. This energy is delivered, in flyback mode, to the auxiliary supply during the off-time of the switch.

A switching circuit is preferably provided for controlling the electrical connection and disconnection of the preload from the output of the driver. This is used to reduce the losses in the circuit. Switching can be used because in normal operation mode the LEDs are on and as such there is energy stored in the inductor.

Thus, the losses may be controlled as a function of the operation mode.

The controller may be further adapted to provide control of the switched mode power supply to provide constant voltage control of the auxiliary power supply voltage when the LED lighting is in a standby mode. The inductor configuration ensures that the LED load remains off, and this means the switched mode power supply can be controlled to generate the auxiliary supply in the most efficient manner.

The switched mode power supply preferably further comprises a main switch for controlling the current flow through the energy storage inductor.

The switched mode power supply for example comprises a single stage buck converter or a single stage buck-boost converter. The switched mode power supply for example comprises a non-isolated converter. In this way, the main energy storage inductor directly supplies power to the output load, not through a transformer. These are low-cost, and hence low performance drivers.

The invention also provides an LED lighting circuit comprising:

a driver as defined above;

an LED lighting load driven by the driver; and an auxiliary load driven by the auxiliary power supply circuit.

The auxiliary load may be a microcontroller unit (MCU) which implements dimming functionality. It may be an IC which also controls the main switch of the switched mode power supply.

Examples in accordance with another aspect of the invention provide an LED lighting method comprising:

delivering energy to an LED lighting load using a switched mode power supply having an energy storage inductor;

generating an auxiliary power supply using an auxiliary power supply circuit having a first power supply inductor and a second power supply inductor in series with the first power supply inductor, magnetically coupled to the energy storage inductor, and a rectifier diode arrangement, and supplying an auxiliary power supply output voltage to an auxiliary load; and selectively switching the second power supply inductor into or out of the auxiliary power supply circuit, thereby varying a transformer ratio to the energy storage inductor.

This method provides a controlled transformer ratio so that a suitable auxiliary power supply can be generated even when a low voltage is desired across the main output load.

The second power supply inductor is for example connected into the switched mode power supply circuit when the LED lighting is in a standby mode and it is disconnected from the switched mode power supply circuit when the LED lighting is in a light output mode.

The method may further comprise controlling the electrical connection of a preload at the output of the driver. This may be used to improve the overall circuit efficiency by reducing loses.

The method may comprise controlling the switched mode power supply to provide constant voltage control of the auxiliary power supply voltage when the LED lighting is in a standby mode.

Delivering energy to the LED lighting load may comprise using a single stage non-isolated buck converter or single stage non-isolated buck-boost converter.

BRIEF DESCRIPTION OF THE DRAWINGS

Examples of the invention will now be described in detail with reference to the accompanying drawings, in which.

DETAILED DESCRIPTION OF THE EMBODIMENTS

The invention provides an LED lighting driver having a switched mode power supply which generates an auxiliary power supply. The auxiliary power supply circuit has a first power supply inductor and a second power supply inductor in series with each other. The second power supply inductor is selectively switched into or out of the auxiliary power supply circuit, thereby varying a transformer ratio to the main energy storage inductor of the switched mode power supply. The switching may be made based on a light output mode or a standby mode being in operation. The standby mode then enables more efficient generation of an auxiliary supply voltage.

The invention is of particular interest for low-cost switched mode power supplies, for which a buck converter and a buck-boost converter are the most common examples.

Figure 1:
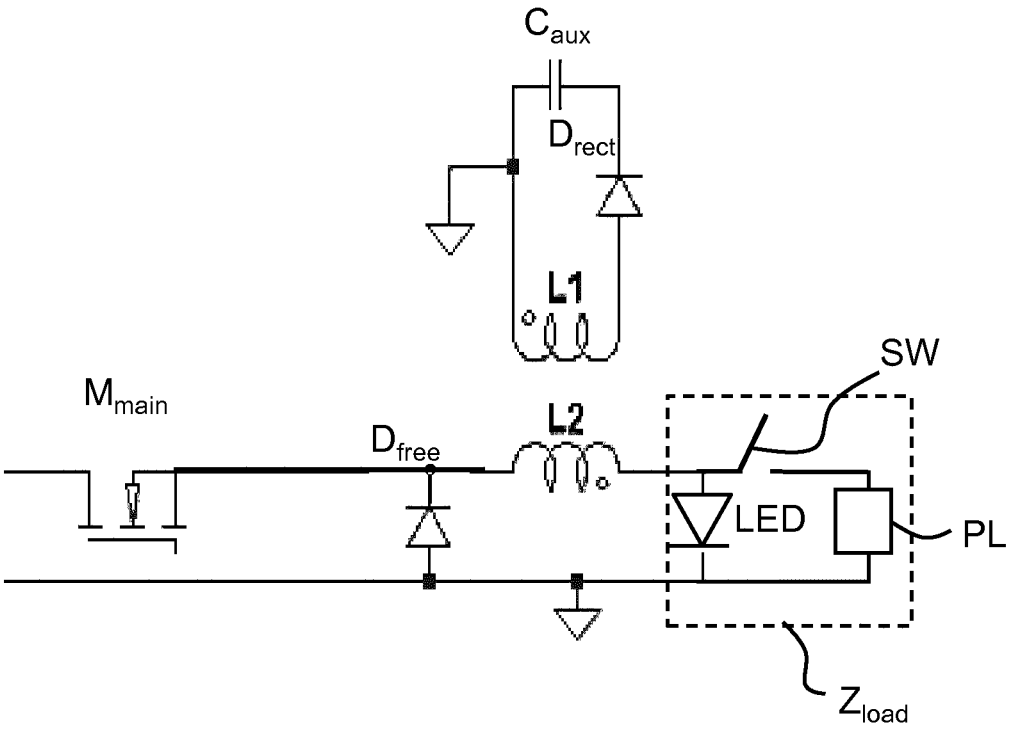
FIG. 1 shows the layout of a standard single stage non-isolated buck converter.

FIG. 1 shows a buck converter (a step-down converter) having an inductor L2 as the primary energy storage element.

The buck converter has the current in the inductor L2 controlled by two switches, a main power switch in the form of a transistor $M_{main}$ and a freewheeling diode $D_{free}$. The load of the circuit is represented by the inductor $Z_{load}$ which comprises LEDs "LED" in parallel with a resistive preload PL. The main power switch, inductor and load are in series, and the freewheeling diode $D_{free}$ is connected in parallel across the series combination of the inductor and load.

In the transistor open state, the current in the circuit is initially zero. When the transistor is first turned on, the current will begin to increase, and the inductor will produce an opposing voltage across its terminals in response to the changing current. This voltage drop counteracts the voltage at the input and therefore reduces the net voltage across the load. Over time, the rate of change of current decreases, and the voltage across the inductor also then decreases, increasing the voltage at the load. During this time, the inductor stores energy in the form of a magnetic field. The transistor is opened while the current is still changing, so that there is always a voltage drop across the inductor, and the net voltage at the load will always be less than the input voltage source.

The inductor functions alternately as a current source to the load and a current sink from the input.

FIG. 1 shows that the main inductor L2 can also be used to generate an auxiliary power supply. As shown, the auxiliary power supply comprises an inductor L1 magnetically coupled to the main inductor L2, and a rectifier diode $D_{rect}$. This delivers a rectified auxiliary power supply to an auxiliary load, represented by capacitor $C_{aux}$.

In the case of a lighting circuit, the main load $Z_{load}$ is the LED lighting and the preload and the auxiliary load $C_{aux}$ may be a controller for example for controlling the timing of operation of the main switch $M_{main}$. This controller for example implements dimming functionality.

Figure 2:
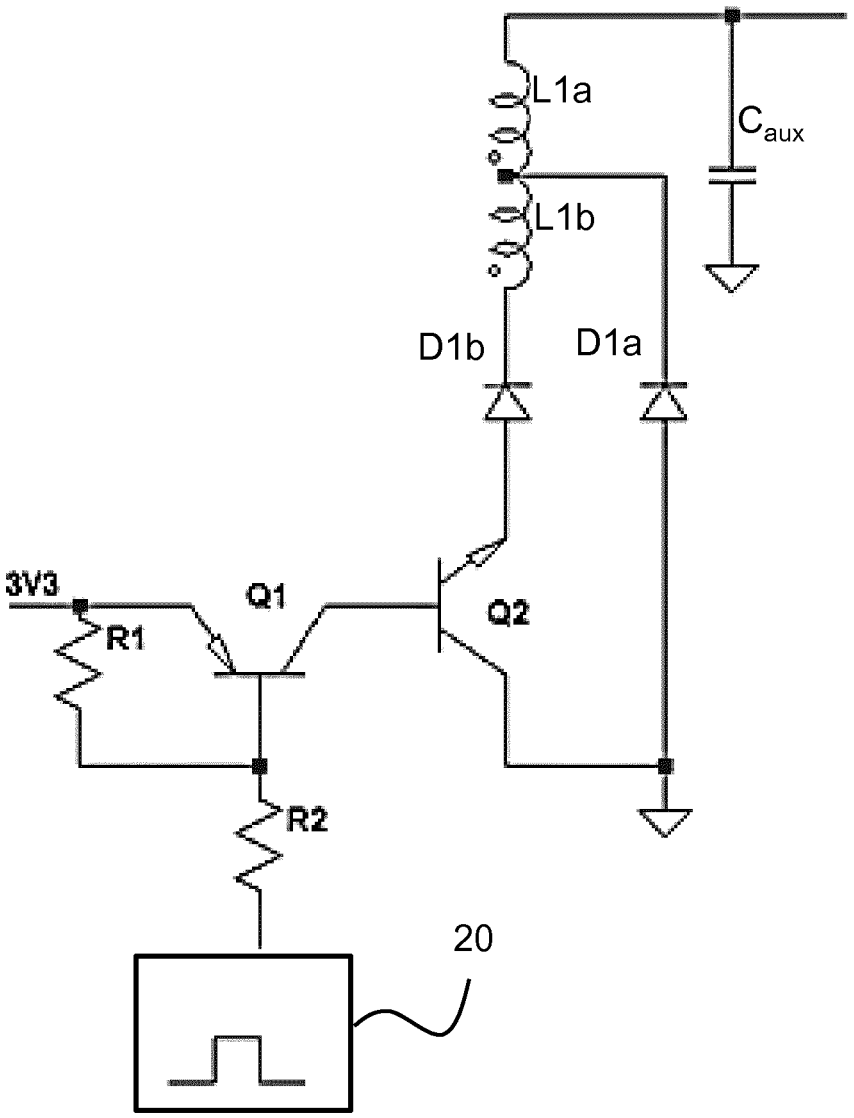
FIG. 2 shows an auxiliary power supply circuit in accordance with the invention.

The invention provides a modification to the auxiliary power supply circuit, as shown in FIG. 2.

The power supply inductor L1 of FIG. 1 is replaced with a first power supply inductor L1*a* and a second power supply inductor L1*b* in series with the first power supply inductor. The two inductors are thus replacing the coupled inductor L1 for the auxiliary supply generation.

A switching circuit is used to set two different configurations of the two inductors. In particular, the inductor that is functional within the auxiliary supply circuit may comprise only the first inductor L1*a* or it may comprise both inductors L1*a*, L1*b*. Thus, the second power supply inductor may be switched into or out of the auxiliary power supply circuit. This varies a transformer ratio to the main energy storage inductor L2 (shown in FIG. 1). The energy storage inductor L2 is magnetically coupled to both inductors L1*a* and L1*b*, so that the connection of one or both inductors in the secondary side circuit (i.e. the auxiliary power supply circuit) effectively alters the transformer ratio with the primary side circuit (i.e. the switched mode power supply circuit).

The switching circuit comprises a first diode D1*a* which connects between ground (more generally a reference voltage) and one end of the first inductor L1*a* (at the junction between the two inductors). There is a second diode D1*b* which connects to one end of the second inductor L1*b* (at the end opposite the junction). Thus, there is one path through diode D1*b* and both inductors to the auxiliary supply load, and another path through diode D1*a* and the first inductor L1*a* to the auxiliary supply load. There are in this way two conduction paths, and the two diodes function as a rectifier diode arrangement.

A transistor Q2, which also forms part of the auxiliary power supply circuit, is in series with the second diode D1*b* so that the second inductor L1*b* can be coupled to ground through the diode D1*b* or it can be isolated from the circuit.

A controller 20 controls the switching circuit in dependence on the desired lighting level. It controls the base voltage to the transistor Q2, by means of a further control transistor Q1. The voltage to the base of transistor Q1 is controlled by the controller 20, and this in turn controls if the base of transistor Q2 is pulled high (to turn it on) or left open circuit (to turn it off).

When the transistor Q2 is turned on, the diode D1*a* is automatically blocking because of the positive voltage at the cathode.

The power supply to the switching circuit "3V3" is the auxiliary power supply, after regulation by a low drop out voltage regulator.

By changing the inductor configuration, the transformer ratio is altered. This means that the voltage across the auxiliary supply can be reduced (relative to the main switched mode converter circuit) during normal operation mode and increased during a standby mode thereby maintaining a desired power transfer to the auxiliary power supply circuit, so that a desired auxiliary power supply voltage can be generated in an efficient manner.

When both inductors are used for the standby mode, the large effective number of turns on the auxiliary supply side (and corresponding transformer ratio) means that a suitable auxiliary supply voltage is enabled with high efficiency, even though the voltage across the primary side inductor is lower, for example around half of the forward voltage of the LEDs (which are thus turned off).

When one inductor is used for the normal operation mode there is a relatively small effective number of turns on the auxiliary supply side (and corresponding transformer ratio) so that an excessive auxiliary supply voltage is prevented. Thus, if the full turns ratio (with both inductors) is suitable for generating an auxiliary supply from the low standby voltage, then the auxiliary supply will otherwise be too high when in normal operating mode. The inductor switching enables this to be prevented. Looked at the other way around, the increased turns when in standby mode enables a sufficient auxiliary supply voltage still to be generated.

A reduction in the number of turns on the secondary side corresponds to an increase in the transformer ratio (e.g. 4:1 instead of 4:2).

The transformer formed by the inductors is a step down transformer, for example stepping down from an LED string forward voltage of typically tens of volts to the desired auxiliary supply voltage for example of 5V.

This arrangement thus reduces the steady state (normal operation) losses by providing a different transformer ratio.

Both in nominal and standby operations the auxiliary supply can be optimized for lowest losses.

As mentioned above, the driver may further comprise a switchable preload PL at the output of the driver. This is used to reduce the losses in the circuit. In particular, this enables the losses to be reduced even further, by adopting a switchable approach for the preload. The preload is reduced in nominal operation conditions causing reduced losses.

The use of a preload is known for dual output single stage converters, and in buck converters in particular there is a desire for such a preload.

The preload is switched in dependence on the circuit mode, in particular standby mode or normal operation mode. It may also be used in a deep dimming mode where the lighting load decreases. FIG. 1 shows a switch SW in series with the parallel preload PL. During the standby mode, the inductor configuration enables a low output voltage, for example below half of the LED arrangement forward string voltage, so that control of switched mode power supply may be used to provide a constant voltage at the output of the auxiliary power supply.

Figure 3:
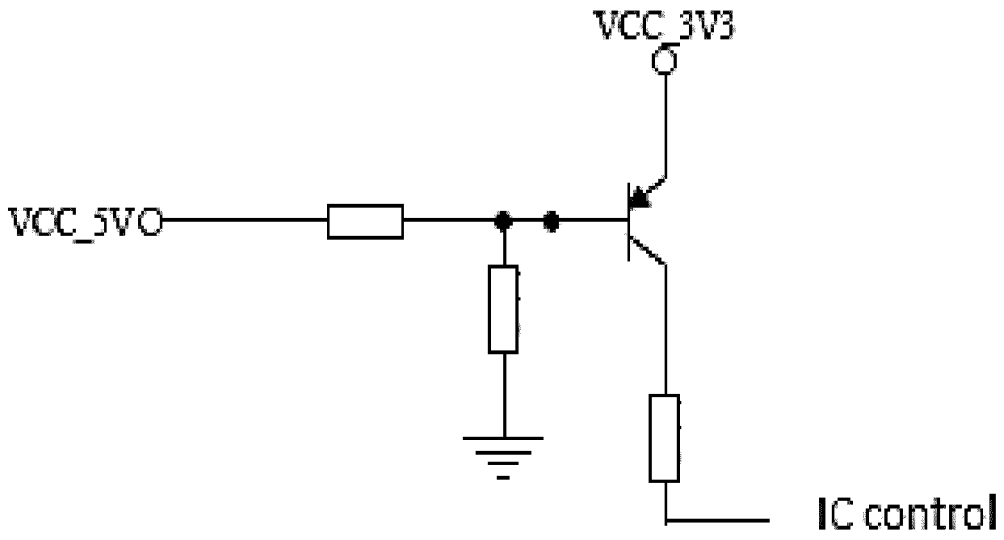
FIG. 3 shows a control circuit for controlling the switched mode power supply during regulation of the auxiliary supply voltage.

FIG. 3 shows a circuit for generating the control signal "IC control" for an IC controller which then controls the main switch $M_{main}$ to provide a regulated auxiliary supply voltage when in standby mode.

VCC_3V3 is the low drop out regulator output of the auxiliary supply. The current flowing through the transistor thus depends on the voltage level, thus providing feedback control. The VCC_3V3 signal from the linear regulator is used as a reference for controlling the standby voltage.

The VCC_5V signal is the auxiliary supply before the LDO. Thus, both signals VCC_3V3 and VCC_5V will vary together, but the circuit still provides a suitable feedback signal. The feedback controls the main switch duty cycle in order to control the 5V output. The 3.3V output is used as a reference voltage.

The switched mode power supply for example comprises a single stage buck converter or a single stage buck-boost converter.

The single stage converter is for example a single stage circuit with power factor correction and other functions such as the auxiliary supply and dimming function.

The switched mode power supply for example comprises a non-isolated converter. These are low-cost, and hence low performance drivers, for which flicker may be an issue as a result of a non-perfect decoupling between an auxiliary power supply and the main circuit load.

The invention also provides an LED lighting circuit comprising:

a driver as defined above;

an LED lighting load driven by the driver; and an auxiliary load driven by the auxiliary power supply circuit.

The auxiliary load may be a microcontroller unit (MCU) which implements dimming functionality. It may be an IC which also controls the main switch of the switched mode power supply.

The invention is of particular interest for a single string, single stage buck implementation with switchable flyback control of a constant voltage auxiliary power supply. The use of a preload enables high efficiency operation with current control for the main load and voltage control for the auxiliary power supply.

Low-cost controllers widely used in the market can be used to control the single stage converter.

Figure 4:
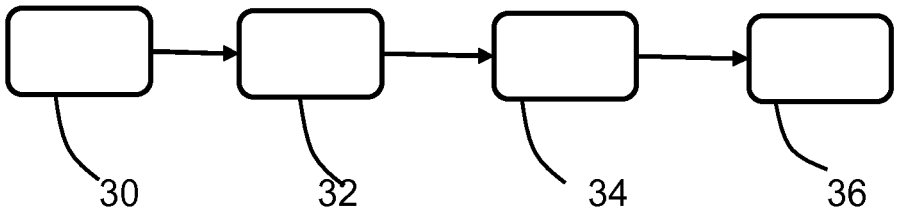
FIG. 4 shows an LED lighting drive method in accordance with the invention.

FIG. 4 shows the method by which the circuit of FIG. 2 operates.

In step 30, energy is delivered to an LED lighting load using a switched mode power supply having a main energy storage inductor.

In step 32 an auxiliary power supply is generated using a power supply inductor arrangement which comprises a first power supply inductor L1*a* and a second power supply inductor L1*b* in series and coupled to the main energy storage inductor.

In step 34, the auxiliary power supply is provided to an auxiliary load.

In step 36 the second power supply inductor is selectively switched into or out of the auxiliary power supply circuit, thereby varying a transformer ratio to the main energy storage inductor.

The invention is of interest for lighting systems with integrated power architectures. Of most interest is single stage, single string LED lighting approaches with an integrated microcontroller using an auxiliary supply, especially for low-cost connected lamps.

Only one example of inductor switching circuit is shown above. However, the same core functionality may be implemented in different ways. For example, any suitable switch circuit may be used to generate a configurable inductor circuit.

In the example above, there are two possible transformer ratios. However, this could be increased to 3 or more by having additional inductors within a switched circuit, thereby enabling efficiency optimization at different drive levels or modes of operation. The system may also generate multiple auxiliary supply voltage levels. Furthermore, the first and second power supply inductors may be placed in parallel instead of in series. The switching circuit may then select one of the power supply inductors to be coupled to auxiliary load.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. An LED lighting driver having a light output mode and a standby mode, the LED lighting driver comprising:

an output for coupling to an LED lighting load;

a switched mode power supply having an energy storage inductor for delivering energy to the LED lighting load; and an auxiliary power supply circuit comprising:

a power supply inductor arrangement magnetically coupled to the energy storage inductor and comprising a first power supply inductor and a second power supply inductor, a rectifier diode arrangement for delivering a rectified voltage to an auxiliary load, and a switching circuit for selectively switching the second power supply inductor into or out of the auxiliary power supply circuit, thereby varying a transformer ratio to the energy storage inductor, the LED lighting driver further comprising:

a controller for controlling the switching circuit in dependence on a desired lighting level, and a switchable resistive preload, that is switched on or off, at the output of the LED lighting driver in dependence on the light output mode or standby mode, wherein the power supply inductor arrangement provides a constant voltage at the output of the auxiliary power supply circuit when the LED lighting driver is in standby mode, and wherein the switchable resistive preload is reduced in a nominal operation.

2. A LED lighting driver as claimed in claim 1, wherein the controller is adapted to control the switching circuit to connect the second power supply inductor into the auxiliary power supply circuit when the LED lighting driver is in the standby mode and to disconnect the second energy storage inductor from the auxiliary power supply circuit when the LED lighting driver is in the light output mode.

3. A LED lighting driver as claimed in claim 1, wherein the switching circuit comprises:

a first diode between a reference terminal and a first end of the second power supply inductor where it connects to the first power supply inductor;

a second diode between the reference terminal and a second end of the second power supply inductor; and a switch in series with the second diode.

4. A LED lighting driver as claimed in claim 1, comprising a further switching circuit for controlling the electrical connection and disconnection of the preload from the output of the driver.

5. A LED lighting driver as claimed in claim 1, wherein the controller is further adapted to provide control of the switched mode power supply to provide a constant voltage control of the auxiliary power supply output when the LED lighting driver is in the standby mode.

6. A LED lighting driver as claimed in claim 1, wherein the switched mode power supply further comprises a main switch for controlling the current flow through the energy storage inductor.

7. A LED lighting driver as claimed in claim 1, wherein the switched mode power supply comprises a single stage buck converter or a single stage buck-boost converter.

8. A LED lighting driver as claimed in claim 1, wherein the switched mode power supply comprises a non-isolated converter.

9. An LED lighting circuit comprising:

a driver as claimed in claim 1;

an LED lighting load driven by the driver; and an auxiliary load driven by the auxiliary power supply circuit.

10. The LED lighting driver as claimed in claim 1, wherein the switchable resistive preload is switched on when the LED driver is in the standby mode, and the switchable resistive preload is switched off when the LED driver is in the light output mode.

11. An LED lighting driver, having a light output mode and a standby mode, a driving method comprising:

delivering energy to an LED lighting load using a switched mode power supply having an energy storage inductor;

generating an auxiliary power supply using an auxiliary power supply circuit having a first power supply inductor and a second power supply inductor in series with the first power supply inductor, magnetically coupled to the energy storage inductor, and a rectifier diode arrangement, and supplying an auxiliary power supply output voltage to an auxiliary load;

selectively switching the second power supply inductor into or out of the auxiliary power supply circuit, thereby varying a transformer ratio to the energy storage inductor; and, controlling an on or off setting of the electrical connection of a resistive preload at the output of the LED lighting driver, in dependence on the light output mode or standby mode, wherein the power supply inductor arrangement provides a constant voltage at the output of the auxiliary power supply circuit when the LED lighting driver is in standby mode, and wherein the switchable resistive preload is reduced in a nominal operation.

12. A method as claimed in claim 11, comprising connecting the second power supply inductor into the auxiliary power supply circuit when the LED lighting driver is in a standby mode and disconnecting the second power supply inductor from the auxiliary power supply circuit when the LED lighting driver is in the light output mode.

13. A method as claimed in claim 11, comprising providing control of the switched mode power supply to provide constant voltage control of an auxiliary power supply output voltage when the LED lighting driver is in the standby mode.

14. A method as claimed in claim 11, wherein delivering energy to the LED lighting load comprises using a single stage non-isolated buck converter or single stage non-isolated buck-boost converter.

* * * * *